US006254450B1

(12) United States Patent
Schonberger

(10) Patent No.: US 6,254,450 B1
(45) Date of Patent: Jul. 3, 2001

(54) DOLL WITH INTEGRATED BOOK FEATURE IN DOLL CAVITY

(76) Inventor: Rachele Schonberger, P.O. Box 515, Double Bay 2028, Sydney (AU)

( * ) Notice: Subject to any disclaimer, the term of this patent is extended or adjusted under 35 U.S.C. 154(b) by 0 days.

(21) Appl. No.: 09/528,842

(22) Filed: Mar. 20, 2000

Related U.S. Application Data

(60) Provisional application No. 60/164,523, filed on Nov. 10, 1999.

(51) Int. Cl.[7] ..... A63H 3/00

(52) U.S. Cl. ..... 446/72; 446/71; 446/262; 434/156

(58) Field of Search ..... 281/15.1; 496/71, 496/72, 202, 321, 268; 434/156, 236, 262

(56) References Cited

U.S. PATENT DOCUMENTS

| | | | | |
|---|---|---|---|---|
| D. 313,044 | | 12/1990 | Spak . | |
| 4,828,289 | | 5/1989 | Körner . | |
| 4,874,340 | * | 10/1989 | Smallwood | 446/72 |
| 4,909,542 | * | 3/1990 | Marks | 281/15.1 |
| 4,921,459 | * | 5/1990 | Cook et al. | 446/321 |
| 5,096,424 | * | 3/1992 | Carlberg | 434/262 |
| 5,197,885 | * | 3/1993 | Friedel | 434/236 |
| 5,472,364 | * | 12/1995 | Castleman | 446/71 |
| 5,816,821 | * | 10/1998 | Ouellette et al. | 434/156 |

* cited by examiner

*Primary Examiner*—Sam Rimell
(74) *Attorney, Agent, or Firm*—Gottlieb, Rackman & Reisman, P.C.

(57) ABSTRACT

A doll having a fabric book as an integral part thereof. The doll has the shape of a real or fictitious human or animal character, and a fabric book with a fabric cover is secured to the doll and arranged so that the cover blends physically into the overall contour of the doll such that when the cover is closed the cover forms part of the doll exterior. The cover is at least partially releasably attached to the doll so that when the cover is released the pages of the fabric book can be turned and read without the book as a whole becoming detached from the doll. The book contains a plurality of fabric pages under the cover, with the fabric cover having an appearance that blends artistically into the appearance of the overall doll and the book pages containing a story or information whose subject is related to the doll itself.

2 Claims, 2 Drawing Sheets

DOLL WITH INTEGRATED BOOK FEATURE IN DOLL CAVITY

This application claims the benefit of U.S. provisional application No. 60/164,523 filed Nov. 10, 1999.

BACKGROUND OF THE INVENTION

This invention relates to an integrated doll and book and, more particularly, to a book in a doll.

There are numerous kinds of dolls that have been made and sold for many centuries. Similarly, there have been many types of children's books that have been marketed. However, there have been surprisingly few attempts at physically combining the two products despite the fact that they can complement each other so admirably. Dolls and books have been sold together, but not as an integrated product.

SUMMARY OF THE INVENTION

The invention is a stuffed doll having the appearance of an animal or human character, or a fantasy or cartoon character, with the doll containing a book comprising text and/or pictures. Preferably, the book has fabric pages. The book is not immediately apparent to the eye because it forms a part of the doll's structure. The book cover actually blends artistically into the clothing or other outer wear of the doll, thus obscuring the book's very existence. The fabric pages of the book are held in a cavity in the doll under the front cover.

The fabric cover is held in place, typically forming part of the doll's clothing, by Velcro or any other type of fastening mechanism. Once the cover is opened, the book pages are revealed and they can be read as can the pages of an ordinary book. The main advantage of the integrated doll and book is that the book can contain a story about the doll or otherwise describe it. It is expected that children who form attachments with such dolls will acquire a love of books since they will clamor to have read to them the books about their dolls.

The doll of the invention may take different forms, including variations in its shape, character, clothing, and the form and subject matter of the book within it. But until the book is revealed, preferably the doll ("doll" is the generic term used herein for any animal, fantasy or other character) has the look and feel of a conventional stuffed toy. In its preferred form, it is soft and pliable although it may have parts that are firm and solid, and it may even have clothing and/or accessories that can be removed and replaced. It may also contain a musical or other sound-producing device, and may be washable in soap and water.

The doll may be made from any or all of the following: fabrics, including natural, synthetic and natural/synthetic blends, synthetic or natural stuffing materials, synthetic fur, plastics and vinyls, rubber materials, and metallic components.

The cavity in the doll that holds the pages of the book may be shaped in any manner to conform with the part of the doll in which it is found. The cavity is opened and closed by means of a cover that is held in place with clips, buttons, studs, Velcro, zippers or other fasteners. Typically, one part of the fastening device is on the back side of the cover and the other part is in the cavity or on the exterior of the doll. The cover blends and merges with the primary material from which the exterior of the doll is made so that, when closed, the cavity is not readily apparent to the eye.

As mentioned above, the book tells a story in text and/or pictures related to the doll, and may include, in addition to character-based material, non-fiction, educational or factual material. The book may be bound in conventional form; it may be comprised of fold-out pages, either concertina-style or in other configurations; and it may be comprised of loose leaves which may or may not be held together by a binding device. The book as a whole may be permanently attached to the doll, or it may be detachable in which case interchangeable books may be used. Even if the book is detachable, however, when the cover is released the pages of the book can be turned and read without the book as a whole becoming detached from the doll. Fabric pages are preferred so that the entire doll, including the book, may be washed, although paper or other materials may be used for the pages if desired. The fabrics used for the book may be the same as those used for the doll.

BRIEF DESCRIPTION OF THE DRAWINGS

Further objects, features and advantages of the invention will be understood upon consideration of the following detailed description in conjunction with the drawing, in which.

DETAILED DESCRIPTION OF THE PREFERRED EMBODIMENTS

Figure 1:
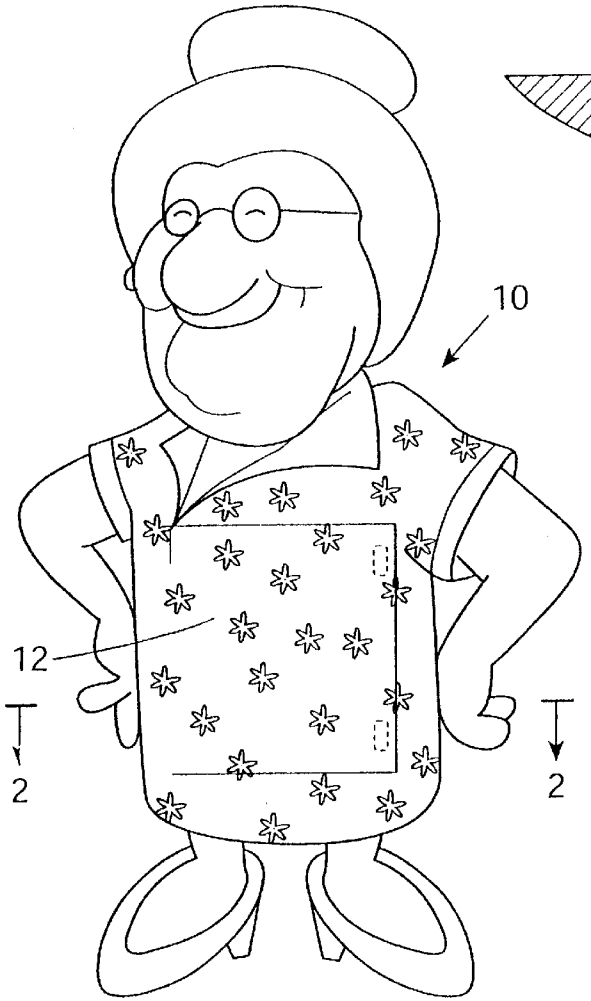
FIG. 1 depicts the first illustrative embodiment of the invention with the book in its closed position.

Doll 10 of FIG. 1 has the appearance of an ordinary rag doll. The cover 12 of the book to be described below blends in physically with the clothing worn by the doll and the overall contour of the doll. Although a near-perfect blend is shown, in practice that is not possible. But it is not necessary for the book to be totally hidden. In fact, some telltale sign should be present so that the child whose doll it is will recognize that there is an attached book. In all cases, however, the book cover, when the book is closed, should form part of the exterior of the doll.

Figure 2:
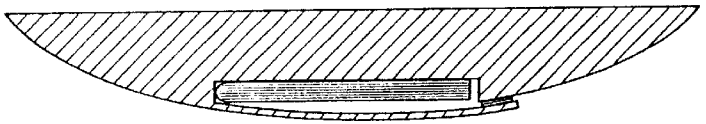
FIG. 2 is a cross-section through the line 2—2 of FIG. 1.

The book is shown partially open in FIG. 2. The numeral 20 represents the region of the spine of the book, a linear region along which the book pages are all attached. The left edge of the cover is permanently attached to the doll while the right edge is releasably attached. It is possible for the left edge to be detachable as well so that multiple books can be used with the same doll figure. However, in use, it should be possible to turn the pages of the book without the book as a whole becoming detached from the doll.

Figure 3:
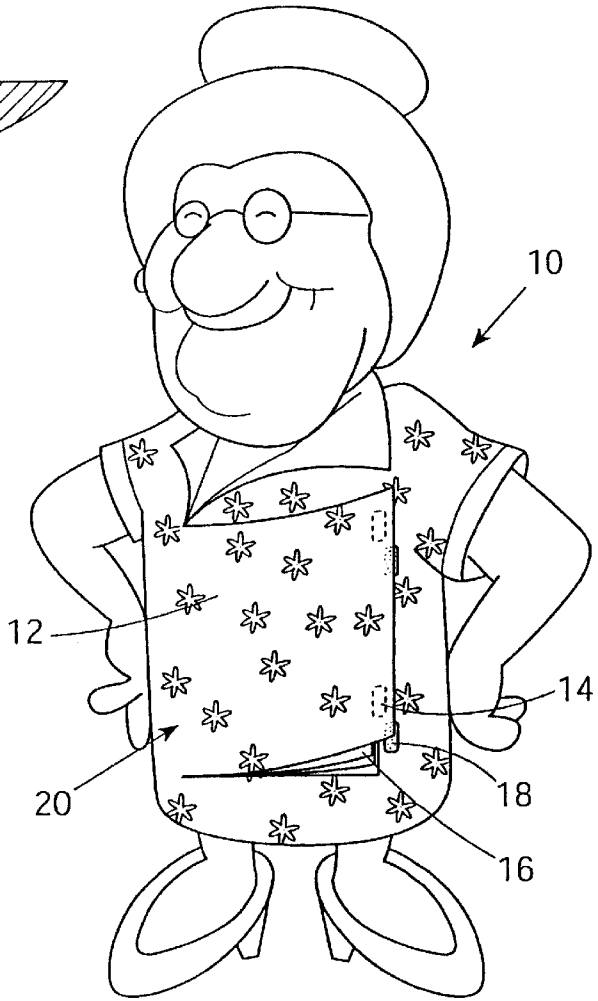
FIG. 3 shows the doll of FIG. 1 with the book partially open.
Figure 4:
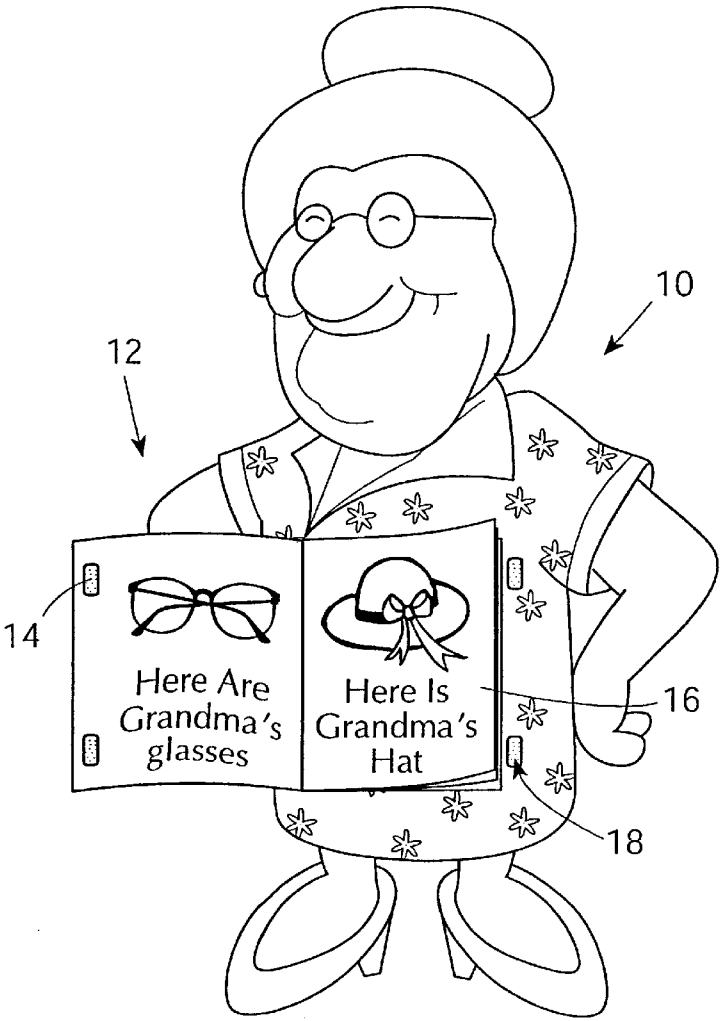
FIG. 4 shows the same doll with the book fully open.

Pages 16 of the book are visible in the drawing of FIG. 3 behind the cover 12. The pages are made of fabric, and they lay in the cavity region seen most clearly in FIG. 2. Two Velcro patches 14 are secured to the inside of the cover 12, and they mate with complementary patches 18 on the exterior of the doll to hold the cover in place when the book is closed. In FIG. 3 the cover has just been released from its closed position. The book is shown fully open in FIG. 4.

Figure 5:
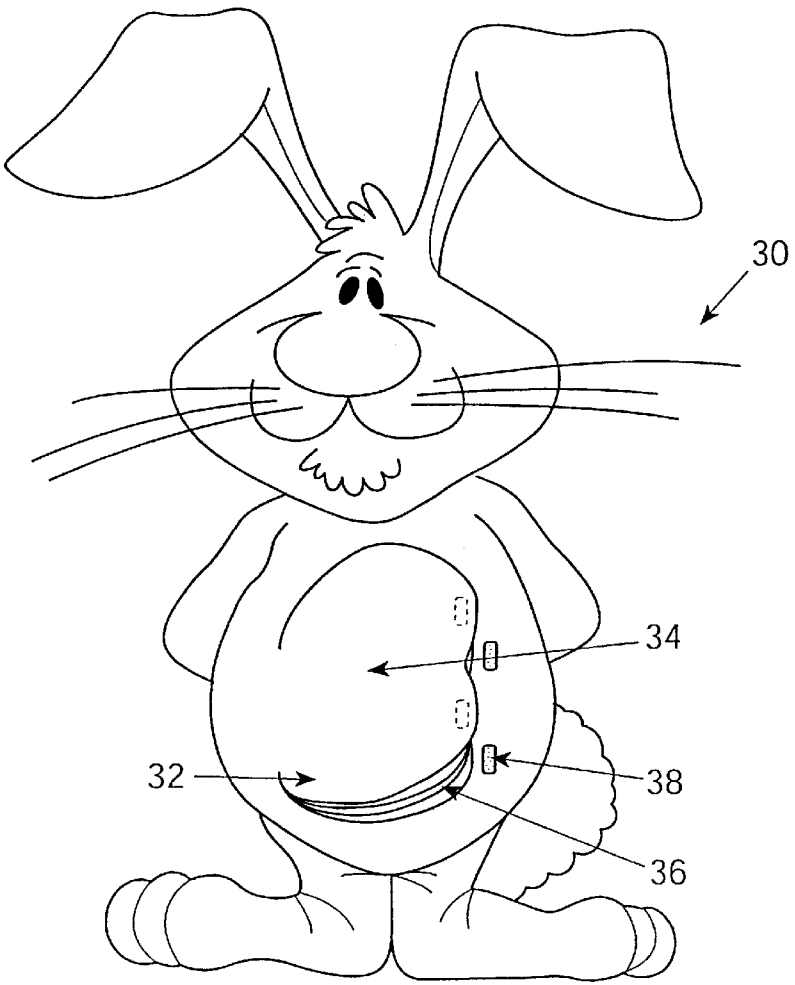
FIG. 5 depicts the second illustrative embodiment of the invention with the book in its partially open position.

The embodiment of the invention shown in FIG. 5 is quite similar to that shown in FIGS. 1–4. In this case, the doll 30 has the shape of a cartoon character. Book 32 has a front cover 34 and several other pages 36, and is functionally similar to the book of the first embodiment (although its spine is not as straight).

Although the invention has been described with reference to particular embodiments, it is to be understood that these embodiments are merely illustrative of the application of the principles of the invention. Numerous modifications may be made therein and other arrangements may be devised without departing from the spirit and scope of the invention.

I claim:

1. A doll having a book as an integral part thereof comprising a doll in the shape of a human or animal character and having a front surface, a back surface and a cavity extending into the front surface thereof, and a book with a fabric cover and fabric pages secured to said doll and arranged so that said pages are within said cavity completely out of view and said cover blends physically into the overall contour of said doll such that when the cover is closed the cover forms part of the doll exterior, said cover being releasably attached to said doll so that when said cover is released the pages of said book can be turned and read without the book as a whole becoming detached from the doll, said cover having an appearance that blends artistically into the appearance of the overall doll and said book pages containing a story or information whose subject is related to the doll character.

2. A doll having a book in accordance with claim 1 wherein the doll and the integral book are both washable.

* * * * *